United States Patent [19]

Nishida et al.

[11] Patent Number: 4,587,707

[45] Date of Patent: May 13, 1986

[54] METHOD FOR MANUFACTURE OF COMPOSITE MATERIAL CONTAINING DISPERSED PARTICLES

[75] Inventors: Yoshinori Nishida, Kasugai; Tsunemichi Imai, Nagoya; Hiromi Matsubara, Aichi, all of Japan

[73] Assignees: Agency of Industrial Science & Technology; Ministry of International Trade & Industry, both of Tokyo, Japan

[21] Appl. No.: 469,693

[22] Filed: Feb. 25, 1983

[30] Foreign Application Priority Data

Mar. 29, 1982 [JP] Japan ..... 57-50869

[51] Int. Cl.[4] ..... B22D 23/06; B22F 3/24

[52] U.S. Cl. ..... 29/527.7; 164/80; 164/55.1; 164/58.1; 164/97; 164/98; 164/120; 164/112; 419/28; 428/539.5

[58] Field of Search ..... 29/527.7; 164/80, 120, 164/59.1, 58.1, 57.1, 108 US, 97, 98, 99, 109, 110, 111, 112, 55.1; 419/28; 428/539.5

[56] References Cited

U.S. PATENT DOCUMENTS

| | | | |
|---|---|---|---|
| 370,436 | 9/1887 | Wheeler | 164/108 |
| 1,166,167 | 12/1915 | Woods | 164/80 |
| 3,013,329 | 12/1961 | Fraser | 419/28 |
| 3,061,924 | 11/1962 | Brick et al. | 29/527.7 |
| 3,447,913 | 6/1969 | Yntema | 428/539.5 |
| 3,546,769 | 12/1970 | Schwope et al. | 419/28 |
| 3,918,141 | 11/1975 | Pepper et al. | 29/527.7 |
| 3,970,136 | 7/1976 | Cannell et al. | 164/108 |
| 4,279,289 | 7/1981 | Ban et al. | 164/97 |

FOREIGN PATENT DOCUMENTS

| | | | |
|---|---|---|---|
| 370041 | 6/1963 | Switzerland | 29/527.7 |
| 2033805 | 5/1980 | United Kingdom | 164/97 |
| 2088761 | 6/1982 | United Kingdom | 164/97 |

OTHER PUBLICATIONS

Metallurgical Transactions B, Aluminum Matrix Composites: Fabrication and Properties, vol. 7B, Sep. 1976, pp. 443–451.

AFS Transactions, Dispersion of Graphite Particles in Aluminum Castings through Injection of the Melt, pp. 402–406, 1969.

*Primary Examiner*—Howard N. Goldberg
*Assistant Examiner*—Vernon K. Rising
*Attorney, Agent, or Firm*—Oblon, Fisher, Spivak, McClelland & Maier

[57] ABSTRACT

A composite material containing dispersed particles is manufactured by disposing within a mold a porous shaped article of ceramic particles, then pouring a molten metal into the mold, compressing the contents of the mold, subsequently allowing the molten metal to solidify, and subjecting the resultant solidified composite to a plasticizing treatment.

5 Claims, 4 Drawing Figures

METHOD FOR MANUFACTURE OF COMPOSITE MATERIAL CONTAINING DISPERSED PARTICLES

BACKGROUND OF THE INVENTION

1. Field of the Invention

This invention relates to a method for the manufacture of a composite material containing ceramic particles dispersed in a metal matrix.

2. Description of the Prior Art

A number of techniques have been heretofore available for the manufacture of a composite material containing dispersed particles. A technique which resorts to solidification is one of these techniques.

The solidification technique is based on a procedure which comprises dispersing particles composed of materials such as ceramics in a mass of molten metal, pouring the resultant composite in a cast, and causing the composite to solidify therein. The most difficult problems encountered in the solidification technique are how keep the particles uniformly dispersed in the molten metal and how to keep the particles in the dispersed state in the molten metal during the solidification of the composite. Now, typical methods embodying the solidification technique will be described below. In one method the metal is melted to a point where the produced molten metal still contains within the liquid state (molten metal) a portion of the metal in its non-molten state. The metal, therefore, assumes a high viscosity such that when the ceramic particles are incorporated therein, the molten metal will not easily release the ceramic particles. Accordingly the ceramic particles are dispersed in the state described above in the molten metal, solidifying the resultant composite (September, 1976 issue of "Metallurgical Transaction B, Volume 7B, 443–450).

Another method contemplates adding to the molten metal an alloy element capable of increasing the viscosity of the molten metal. This allows the molten metal to assume a state capable of readily keeping the incorporated ceramic particles dispersed fast therein (Glossary of Manuscripts for Lectures at the 60th Spring Meeting of Japan Light Metal Study Society held in May 1981).

Yet another method contemplates applying a metal plate to the surface of the ceramic particles thereby enabling the particles to be amply wetted with the molten metal and consequently dispersed advantageously therein (1969 issue of AFS Transaction, pp 402–406). The above methods involve complicated processes and afford products of stable quality only with difficulty. These methods have been impractical for the actual manufacture of a composite material particularly when the particles are of a type not readily intermingled with the molten metal.

The object of this invention is to provide a method for the manufacture of a composite containing therein dispersed particles, which method permits easy dispersion of the particles in the molten metal and permits manufacture of a composite material of stable quality.

SUMMARY OF THE INVENTION

To accomplish the object described above according to the present invention, there is provided a method for the manufacture of a composite material containing therein dispersed particles, which method is characterized by uniformly disposing within a mold a porous shaped article of aggregated ceramic particles, pouring a molten metal into the mold, applying high pressure to bear upon the molten metal received in the mold thereby causing the molten metal to penetrate thoroughly into the pores distributed within the shaped article of particles, allowing the thus distributed molten metal to solidify in situ and form a solid composite incorporating therein the aforementioned shaped article of particles, subjecting the solid composite to a plasticizing treatment thereby breaking up the shaped article of ceramic particles and allowing the ceramic articles to be dispersed within the metal.

BRIEF DESCRIPTION OF THE DRAWINGS

Other objects and features of the invention will become apparent to those skilled in the art as the disclosure is made in the following description of a preferred embodiment of the invention, as illustrated in the accompanying sheets of drawings, in which.

DESCRIPTION OF THE PREFERRED EMBODIMENT

The method of this invention must be preceded by the preparation of a porous shaped article of ceramic particles. This shaped article of ceramic particles can be easily produced by the method described below. This shaped article of ceramic particles is easily produced in a porous state by mixing ceramic particles with an organic or inorganic binder, compression molding the resultant mixture in the shape of a slender bar of a circular cross section or polygonal cross section or in the shape of a thin flat plate, and sintering the shaped article at elevated temperatures thereby expelling the binder by combustion. The shaped article must be formed with strength enough to keep its shape intact despite the intense heat of the combustion of the binder.

Examples of the material for the aforementioned ceramic particles are $Al_2O_3$, $SiO_2$, $ThO_2$, and $TiO_2$. The particle size of these ceramic particles is desired to fall in the range of 0.1 to 200 μm. Examples of the binder are polyvinyl alcohol and methyl cellulose. The pores distributed in the shaped article of particles are desired to account for about 65 to 80% by volume of the shaped article.

Now, the present invention will be described with reference to the accompanying drawings.

Figure 1:
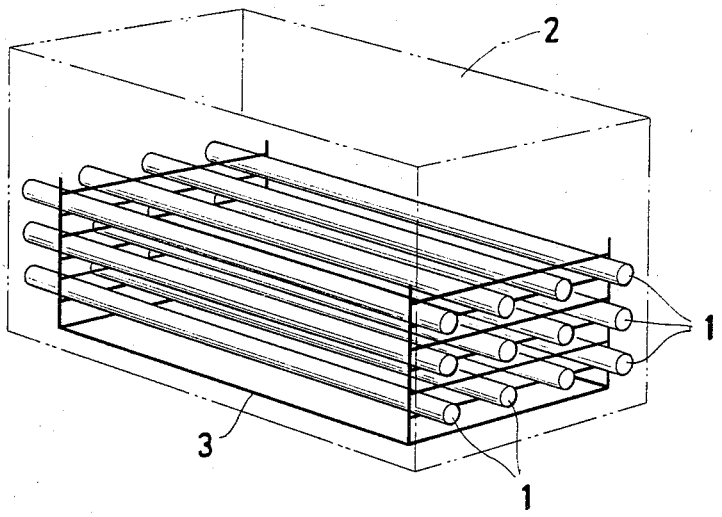
FIG. 1 is a perspective view illustrating a typical disposition of the shaped article of particles within the mold involved in working the method of the present invention.

First, a plurality of porous shaped articles of particles 1 (slender bars having a circular cross section in the embodiment of FIG. 1) are disposed substantially uniformly within a mold 2 as illustrated in FIG. 1. This disposition of the shaped articles 1 may be effected by installing a holding base 3 as illustrated and setting the shaped articles 1 in position on the holding base 3, by providing the mold 2 on the lateral wall thereof with a corrugated surface adapted to support the shaped articles 1 in position and consequently allowing the shaped articles to be directly supported on the mold 2, or by piling the shaped articles 1 as coarsely spaced thereby filling up the entire cavity of the mold.

Figure 3:
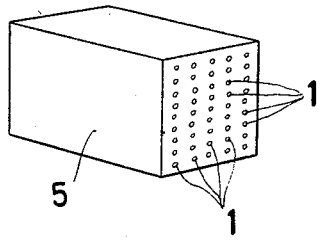
FIG. 3 is a perspective view illustrating a typical solid composite to be formed while the method of this invention is worked.
Figure 2:
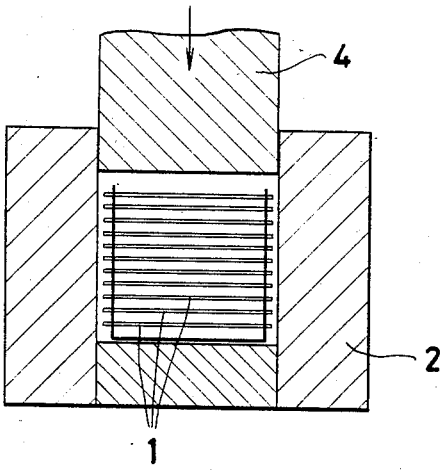
FIG. 2 is a cross section illustrating the application of high pressure upon the molten metal poured in the mold in working the method of this invention.

Then, a molten metal is cast into the mold 2 having the aforementioned shaped articles 1 disposed therein as described above. Immediately, high pressure of 500 to 1000 atmospheres is mechanically exerted through the medium of a punch 4 to bear upon the cast molten metal as illustrated in FIG. 2. Owing. to the pressure thus applied, the molten metal is caused to penetrate into the pores distributed in the shaped articles 1, with the result that highly intimate contact will be established between the particles and the molten metal. After the molten metal has been thoroughly admitted into the pores, it is solidified to produce a solid composite as illustrated in FIG. 3. This solid composite 5 contains the shaped articles 1 in situ. It has an internal structure such that the ceramic particles are distributed in a fixed pattern within the metal.

Figure 4:
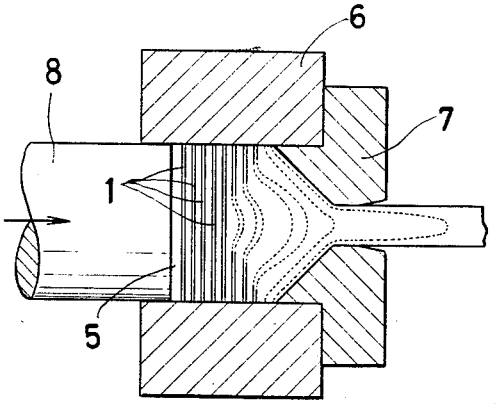
FIG. 4 is a diagram illustrating a typical plasticizing treatment performed on the solid composite while the method of this invention is worked.

Subsequently, the aforementioned solid composite 5 is subjected at room temperature or elevated temperatures to a plasticizing treatment making use of the action of rolling or extruding, with the result that the shaped articles are broken up and the ceramic particles are dispersed in the metal to afford a composite material containing dispersed particles as desired. In this case, when the plasticizing treatment is carried out in the direction of the length of the shaped articles 1, the shaped articles are elongated in the direction of length to produce a composite material having the ceramic particles oriented in the direction of length. When the plasticizing treatment is carried out by means of extrusion at right angles or substantially right angles relative to the direction of length of tne shaped articles 1 by the use of a container 6, a die 7, and a punch 8 as illustrated in FIG. 4, there can be obtained a composite material having an internal structure wherein the ceramic particles are dispersed rather randomly.

Examples of the metal material are aluminum, aluminum alloys, copper, and copper alloys. By combining such metal materials and various ceramic materials, there can be obtained various composite materials having varying sets of properties. Owing to their peculiar properties, these composite materials are used as mechanical parts which are required to offer resistance to wear, ability to absorb vibrations, and high strength.

Examples of the metal-ceramic combination are Al-$Al_2O_3$, Al-$SiO_2$, Al-$TiO_2$, Cu-$Al_2O_3$, Cu-$SiO_2$, Cu-$TiO_2$, and Cu-$ZrO_2$.

Now, the present invention will be described below with reference to working examples.

EXAMPLE 1

A composite material was prepared by having ceramic particles dispersed in aluminum. As a preparatory step, shaped articles of ceramic particles were prepared. First, 100 parts by weight of white molten alumina (#120), 15 parts by weight of a 1:1 mixture of orthoclase particles (not more than 50 μm in particle size) with pottery stone particles (not more than 40 μm in particle size), and 5 parts by weight of molding paste (aqueous 20% dextrin solution) were prepared and thoroughly mixed. The resulting mixture was fed into molds in small amounts of equal weight and compression molded under pressure of 500 kg·f/cm$^2$ to produce thin plates 2 mm×10 mm×100 mm. Since the shaped articles were thin and long, they were formed each on a cardboard to retain their shape. The shaped articles were thoroughly dried, placed in an electric oven, gradually heated, held at the temperature of 1300° C. for about 30 minutes, then slowly cooled and removed from the oven.

The shaped articles of particles thus produced had strength enough to be safely disposed in the cavity of the mold and readily broken down into powder when compressed under slightly increased pressure. The shaped articles had a density of about 2.3 g/cm$^3$, a value slightly smaller than the density of aluminum, 2.38 g/cm$^3$ (at 660° C.). To prevent the shaped articles from floating up the molten metal, these shaped articles, 24 in total were fastened to a holding base made of slightly thick metal wire, as arrayed in three rows and eight columns spaced by intervals of 5 mm in both horizontal and vertical directions, preheated to about 500° C., and then inserted as held fast on the holding base into a mold having an inner volume of 200 mm high, 60 mm wide, and 130 mm long.

Then, the mold temperature was fixed at 300° C. and, before the shaped articles of particles cooled, pure aluminum melted at 750° C. was cast into the mold. Immediately pressure of about 500 kg·f/cm$^2$ was applied to bear upon the molten aluminum through the medium of a punch and cause the molten aluminum to pass into the pores of the shaped articles. Then, the molten aluminum was allowed to solidify, giving rise to a solid composite.

Subsequently, the solid composite as held fast on the holding base was removed from the mold, severed from the holding stand by cutting off the opposite end portions, and rolled in the direction of the length of shaped articles, to afford a composite material.

EXAMPLE 2

Shaped articles of ceramic particles were prepared by the following procedure. The raw materials, 50 parts by weight of white molten alumina (#8000), 5 parts by weight of a binder (polyvinyl alcohol), and 35 parts by weight of water, were thoroughly mixed. The resultant mixture was fed into molds in small amounts of equal weight and compressed under pressure of 200 kg·f/cm$^2$ to produce a thin plate 1.5 mm×10 mm×10 mm. The shaped articles were formed, similarly to those of Example 1, each on a cardboard. They were thoroughly dried, placed in an electric oven, gradually heated, held at 1000° C. for one hour, then cooled gradually, and removed from the oven.

The shaped articles of particles thus obtained were more readily breakable than those of Example 1. They had a density of about 1.4 g/cm$^3$ and, therefore, were light. To prevent the shaped articles from floating up the molten metal, a basket was made of metal gauze and wrapped in a frame made of thin iron sheet. In this basket, the shaped articles of ceramic particles were piled up to full capacity of the basket as spaced amply from one another and were covered with a lid of metal gauze. The basket full of the shaped articles was inserted into the same mold as used in Example 1. Under the same conditions, pure aluminum in a molten state was cast into the mold, compressed under pressure of about 1000 kg·f/cm$^2$, and then allowed to solidify. The resultant solid composite was removed from the mold and trimmed by cutting off the peripheral portions adhering to the metal gauze. From the removed solid composite, a round bar 40 mm in outside diameter was cut out. This round bar was hot extruded at 600° C. to break up the shaped articles of ceramic particles and give rise to a composite material.

The composite material thus obtained had an inner structure such that the shaped articles of particles were broken up in the direction of rolling or hot extruding and the alumina particles were dispersed in the same direction and the portions containing alumina particles as mixed with aluminum and the portions formed solely of alumina were alternately stratified. Thus, the alumina particles were dispersed quite advantageously.

As described in detail above, the present invention accomplishes thorough dispersion of ceramic particles in a metal by disposing within a mold porous shaped articles of ceramic particles, pouring a molten metal into the mold, applying high pressure to bear on the molten metal thereby causing the molten metal to penetrate thoroughly into the pores distributed in the shaped articles, allowing the molten metal to solidify, and thereafter causing plastic deformation of the resultant solid composite thereby dispersing the ceramic particles in the metal. Thus, the method of this invention provides uniform dispersion of ceramic particles in metal safely and permits composite materials of constant quality to be mass produced easily and inexpensively.

What is claimed is:

1. A method for the manufacture of a composite material containing dispersed ceramic particles, comprising the steps of:

preparing porous shaped articles of ceramic particles by mixing ceramic particles with a binder, compression molding the resultant mixture and sintering the compression molded mixture, thereby expelling said binder from the mixture by combustion, disposing said porous shaped articles formed of ceramic particles with a mold, pouring a molten metal into said mold, then applying high pressure to bear upon said molten metal, thereby causing said molten metal to be thoroughly penetrated into the pores distributed within said porous shaped articles of ceramic particles, allowing said molten metal to solidify, thereby giving rise to a solid composite incorporating therein the shaped articles of ceramic particles, and subjecting said solid composite to a plasticizing treatment, thereby breaking up the shaped articles of ceramic particles and allowing the ceramic particles to be dispersed in the metal.

2. A method according to claim 1, wherein the material for the molten metal to be poured into the mold is one member selected from the group consisting of aluminum, aluminum alloys, copper, and copper alloys.

3. The method of claim 1, wherein the ceramic particles have a particle size of between about 0.1 and 200 μm.

4. The method of claim 1, wherein the binder is selected from the group consisting of polyvinyl alcohol and methyl cellulose.

5. The method of claim 1, wherein the pores between the ceramic particles are 65 to 80% by volume of the shaped article.

* * * * *